US006774803B1

(12) United States Patent
Tiffin

(10) Patent No.: US 6,774,803 B1
(45) Date of Patent: Aug. 10, 2004

(54) FAULT TRIP INDICATOR AND MAINTENANCE METHOD FOR A CIRCUIT BREAKER

(75) Inventor: Randolph G. Tiffin, St. Louis, MO (US)

(73) Assignee: Ameren Corporation, St. Louis, MO (US)

( * ) Notice: Subject to any disclaimer, the term of this patent is extended or adjusted under 35 U.S.C. 154(b) by 8 days.

(21) Appl. No.: 10/160,644

(22) Filed: May 31, 2002

(51) Int. Cl.[7] ..... G08B 21/00
(52) U.S. Cl. ..... 340/638; 340/661; 361/114
(58) Field of Search ..... 340/638, 660, 340/661, 662, 650, 664, 635; 361/102, 114; 324/133, 508

(56) References Cited

U.S. PATENT DOCUMENTS

| | | | | |
|---|---|---|---|---|
| 3,674,986 A | | 7/1972 | Paz | |
| 3,801,872 A | | 4/1974 | Zocholl et al. | |
| 4,101,826 A | | 7/1978 | Horsitmann | |
| 4,185,205 A | | 1/1980 | Jagoda et al. | |
| 4,321,681 A | | 3/1982 | Sackin et al. | |
| 4,404,612 A | | 9/1983 | Hughes et al. | |
| 4,468,796 A | | 8/1984 | Suga | |
| 4,642,724 A | | 2/1987 | Ruta | |
| 4,644,438 A | | 2/1987 | Puccinelli et al. | |
| 4,780,786 A | * | 10/1988 | Weynachter et al. | 361/87 |
| 4,812,943 A | | 3/1989 | Jones et al. | |
| 4,814,934 A | | 3/1989 | Jones et al. | |
| 4,937,757 A | | 6/1990 | Dougherty | |
| 5,070,517 A | | 12/1991 | Köchler et al. | |
| 5,357,087 A | | 10/1994 | Choi | |
| 5,448,161 A | | 9/1995 | Byerley, III et al. | |
| 5,510,773 A | * | 4/1996 | Rodgers | 340/638 |
| 5,513,185 A | | 4/1996 | Schmidt | |
| 5,517,381 A | | 5/1996 | Guim et al. | |
| 5,627,717 A | | 5/1997 | Pein et al. | |
| 5,751,532 A | | 5/1998 | Kanuchok et al. | |
| 5,959,537 A | * | 9/1999 | Banting et al. | 340/664 |
| 6,137,666 A | | 10/2000 | Wang | |
| 6,262,872 B1 | | 7/2001 | Messerli et al. | |
| 6,266,225 B1 | | 7/2001 | Mendez | |
| 6,271,759 B1 | * | 8/2001 | Weinbach et al. | 340/635 |

OTHER PUBLICATIONS

Section 8: Breaker Monitor and Metering, SEL–351A Instruction Manual, pp. 8–1 through 8–14, Sep. 9, 1999.

INCON Power Utility Products, This is the OPTImizer, 4 pages, Saco, ME, USA, (date not marked, published more than one year before May 31, 2002).

Barrington Consultants, Inc., Remotely Monitor Timing & Velocity of Every Circuit Breaker Operation, Apr. 12, 2000, 10 pages, Santa Rosa, CA, USA.

* cited by examiner

*Primary Examiner*—Anh V. La
(74) *Attorney, Agent, or Firm*—Senniger, Powers, Leavitt & Roedel

(57) ABSTRACT

A fault trip indicator for use with a circuit breaker connected to protect an electrical line comprises a current transformer coupled to the electrical line to produce a current signal which varies as a function of the current level in the electrical line. A threshold detector is coupled to the current transformer to produce a load signal when the threshold detector detects that the current signal exceeds a threshold value. A monitoring circuit is coupled to the protective circuit in the circuit breaker and the threshold detector to provide an indication of the occurrence of the protective circuit opening the circuit breaker while the threshold detector is producing the load signal. A fault trip indicator using passive circuitry, a battery powered threshold detector and binary load signals are also disclosed. A counter for counting the number of fault trips and a display for displaying the count are also disclosed, as are an auxiliary current transformer coupled to the main current transformer in the circuit breaker to provide the current signal. A method of performing maintenance on a circuit breaker is also disclosed. Other embodiments and features are also disclosed.

31 Claims, 3 Drawing Sheets

FAULT TRIP INDICATOR AND MAINTENANCE METHOD FOR A CIRCUIT BREAKER

BACKGROUND OF THE INVENTION

Oil circuit breakers (OCB's) have been used since the early days of electrical power generation and distribution. For years, the OCB was the only practical type of circuit breaker for voltages between 15 and 230 kilovolts. Only since the 1980's have other types of circuit breakers been able to slowly replace the OCB. The OCB still represents about 85 percent of all circuit breaker types in-service at these voltages.

The OCB's purpose is to open under high current or overload conditions and thus protect the electrical lines, power distribution equipment, and attached electrical loads downstream. The occurrence of an OCB opening during heavy load conditions is usually referred to as a "fault trip." One disadvantage of the OCB is that, after a relatively few number of fault trips, internal contacts become worn out and the oil inside becomes contaminated. This makes it necessary to remove the oil, filter or replace the oil, and replace any worn parts. Such maintenance is typically done many times over the expected life span of the OCB. A typical utility may have hundreds, perhaps thousands, of OCB's to maintain.

While OCB's typically have a target which is set to indicate that a fault trip has occurred, such targets do not store information showing how many fault trips have occurred since the last time the target was reset. Further, such targets do not provide any cumulative information concerning any fault trips which have occurred during a predetermined interval of time. And while computers have been used to measure current flows relating to trips and to estimate wear within a circuit breaker, such prior art equipment is far more complicated and expensive than necessary. What is needed is a simple way to predict when maintenance is needed so that labor and maintenance resources can be maximized.

SUMMARY OF THE INVENTION

Among the objects of the present invention are to provide improved fault trip indicators and maintenance methods which count and display the occurrences of a circuit breaker fault trip; to provide improved fault trip indicators which are reliable, durable, portable and compact; to provide improved fault trip indicators which are capable of ignoring a trip signal that does not coincide with a high current or overload condition; to provide improved fault trip indicators which display the fault trip count locally and/or provide a count signal over a communication line to a remote location; to provide improved fault trip indicators which use passive circuitry; to provide improved fault trip indicators which are easy to install; to provide improved fault trip indicators which are inexpensive to manufacture; and to provide improved maintenance methods for performing predictive maintenance on a circuit breaker.

Generally, one aspect of the invention is a fault trip indicator used with a circuit breaker. The circuit breaker is connected to protect an electrical line and has a protective circuit for opening the circuit breaker during a heavy load condition on the electrical line. The protective circuit includes a main current transformer which senses a current level flowing through the electrical line. The fault trip indicator has an auxiliary current transformer coupled to the main current transformer to produce a current signal which varies as a function of a current level produced by the main current transformer. A threshold detector is coupled to the auxiliary current transformer to produce a load signal when the threshold detector detects that the current signal exceeds a threshold value. The fault trip indicator also has a monitoring circuit coupled to the protective circuit and the threshold detector to provide an indication of the occurrence of the protective circuit opening the circuit breaker while the threshold detector is producing the load signal.

Another aspect of the invention is a fault trip indicator used with a circuit breaker. The circuit breaker is connected to protect an electrical line and has a protective circuit for opening the circuit breaker during a heavy load condition on the electrical line. The fault trip indicator includes a current transformer coupled to the electrical line to produce a current signal which varies as a function of a current level flowing through the electrical line. A battery-powered threshold detector is coupled to the current transformer to produce a load signal when the threshold detector detects that the current signal exceeds a threshold value. The fault trip indicator also has a monitoring circuit coupled to the protective circuit and the threshold detector to provide an indication of the occurrence of the protective circuit opening the circuit breaker while the threshold detector is producing the load signal.

Yet another aspect of the invention is a fault trip indicator used with a circuit breaker. The fault trip indicator is connected to protect an electrical line and has a protective circuit for opening the circuit breaker during a heavy load condition on the electrical line. The fault trip indicator includes a current transformer coupled to the electrical line to produce a current signal which varies as a function of a current level flowing through the electrical line. A threshold detector is coupled to the current transformer to produce a binary load signal when the threshold detector detects that the current signal exceeds a threshold value. The fault trip indicator also has a monitoring circuit coupled to the protective circuit and the threshold detector to provide an indication of the occurrence of the protective circuit opening the circuit breaker while the threshold detector is producing the binary load signal.

Still another aspect of the invention is a fault trip indicator used with a circuit breaker. The circuit breaker is connected to protect an electrical line and has a protective circuit for opening the circuit breaker during a heavy load condition on the electrical line. The fault trip indicator includes a current transformer coupled to the electrical line to produce a current signal which varies as a function of a current level flowing through the electrical line. A passive threshold detector is coupled to the current transformer to produce a load signal when the threshold detector detects that the current signal exceeds a threshold value. The fault trip indicator also has an indicator coupled to the protective circuit and the threshold detector to provide an indication of the occurrence of the protective circuit opening the circuit breaker while the threshold detector is producing the load signal.

Yet still another aspect of the invention is a method of performing maintenance on a circuit breaker where the circuit breaker is connected to protect an electrical line and has a protective circuit for opening the circuit breaker during a heavy load condition on the electrical line. The method includes producing a current signal which varies as a function of the current level flowing through the electrical line and establishing a first threshold value. The method also includes producing a binary load signal as a function of the current signal and the first threshold value. The method further includes providing an indication of the occurrence of the protective circuit opening the circuit breaking while the binary load signal is being produced. The method further includes establishing a second threshold value and performing maintenance on the circuit breaker as a function of the indication and the second threshold value.

Yet still another aspect of the invention is a method of performing maintenance on a circuit breaker where the circuit breaker is connected to protect an electrical line and has a protective circuit for opening the circuit breaker during a heavy load condition on the electrical line. The method includes producing a current signal which varies as a function of the current level flowing through the electrical line and establishing a first threshold value. The method also includes using battery power to produce a load signal as a function of the current signal and the first threshold value. The method further includes providing an indication of the occurrence of the protective circuit opening the circuit breaking while the load signal is being produced. The method further includes establishing a second threshold value and performing maintenance on the circuit breaker as a function of the indication and the second threshold value.

Other objects and features will be in part apparent and in part pointed out hereinafter.

BRIEF DESCRIPTION OF THE DRAWINGS

Corresponding reference characters indicate corresponding parts throughout the several views of the figures.

DETAILED DESCRIPTION OF PREFERRED EMBODIMENTS

Figure 1:
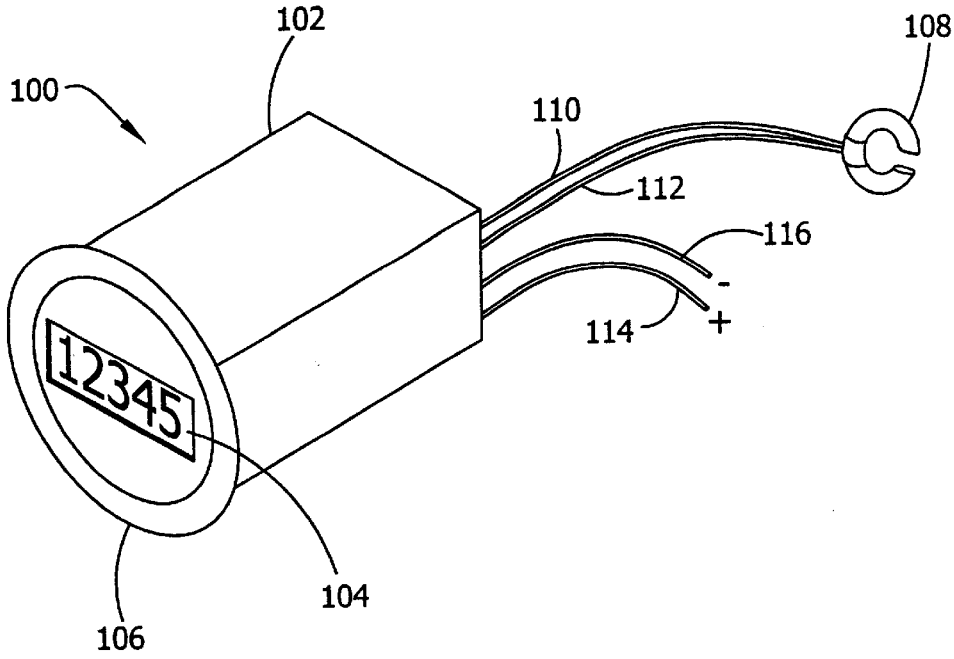
FIG. 1 shows a fault trip indicator of the present invention.

FIG. 1 shows a fault trip indicator 100 of the present invention. Fault trip indicator 100 includes a chassis 102 for enclosing the electrical circuitry comprising the indicator. Fault trip indicator 100 preferably includes a display 104 for displaying the total number of fault trips which have been detected and counted by the fault trip indicator 100. In the situation where the display is reset to zero prior to the installation of the fault trip indicator 100 on a circuit breaker, the count shown on display 104 will be the total number of fault trips detected by the indicator 100 for the circuit breaker subsequent to the installation. Fault trip indicator 100 may include a circular mounting plate 106 or other suitable mounting plate for mounting the fault trip indicator adjacent to the circuit breaker. Alternatively, the fault trip indicator 100 can be allowed to rest on any suitable surface after it has been connected to the circuit breaker.

Fault trip indicator 100 includes a current transformer 108 which provides a current signal to the indicator 100 via lines 110 and 112. Current transformer 108 may be coupled to the electrical line protected by the circuit breaker so as to detect the current level in the electrical line. When making such a direct coupling to the electrical line, the current transformer must have a suitable voltage rating to protect the transformer from the potentially high line voltages. Alternatively, many circuit breakers include their own main current transformers for sensing the current level in the electrical lines to be protected. Current transformer 108 is preferably connected to a lead line from one of the main current transformers on the circuit breaker. In practice, many commercially available circuit breakers employ a protocol whereby the current level on the lead lines of the main current transformer is 5 amperes when the lines are carrying the nominal full current rating. For example, in a 1.2 kA breaker, the main current transformer for the breaker will have 5 amperes running through its leads when the current running through the electrical lines protected by the breaker is 1.2 kA. Similarly for a 2 kA circuit breaker, the main current transformers are sized so that 5 amperes of current are carried by their leads when the current carried by the electrical lines protected by the circuit breaker is at a 2 kA level. This normalization where 5 amperes represents the nominal full load current for the breaker may allow the same fault trip indicator 100 of the present invention to be used on circuit breakers of varying sizes without substantial adjustment to the fault trip indicator 100.

Fault trip indicator 100 has a positive lead 114 and a negative lead 116 which are connected to the protective relay scheme in the circuit breaker to detect a trip signal given to the circuit breaker by the protective relay scheme. In other words, when the trip signal is present on lines 114 and 116, this indicates a time when the protective relay scheme is opening the contacts in the circuit breaker to remove electrical power from the electrical lines downstream of the circuit breaker. In use, fault trip indicator 100 will only increment the count provided by display 104 when both: (1) a heavy current condition is detected by the current transformer 108 in the electrical line protected by the circuit breaker; and (2) a trip signal is detected on lines 114 and 116 indicating that the protective relay scheme for the circuit breaker is trying to open the contacts in the circuit breaker. The occurrence of both such conditions indicates that the circuit breaker is undergoing a fault trip, i.e., an opening of the circuit breaker under heavy load.

Figure 2:
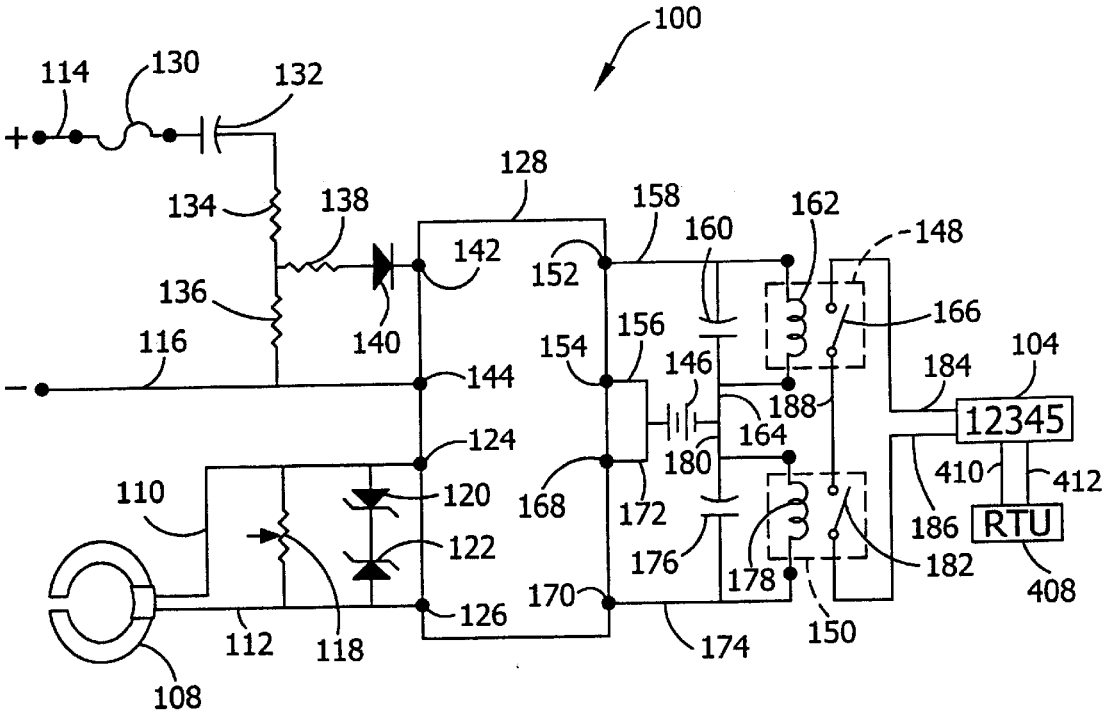
FIG. 2 shows a schematic diagram for a fault trip indicator of the present invention.

FIG. 2 shows an electrical schematic diagram for implementing the fault trip indicator 100 shown in FIG. 1. More particularly, fault trip indicator 100 includes the current transformer 108 as shown in FIG. 1 which may be coupled directly to the electrical line protected by the circuit breaker or may be coupled to a current transformer used by the circuit breaker to monitor the current level in the electrical line. A variable resistor 118 is connected between lines 100 and 112 in parallel with a pair of opposing zener diodes 120 and 122. Lines 110 and 112 are also connected, respectively, to input terminals 124 and 126 of an opto-isolator circuit 128. Opto-isolator circuit 128 may be any of the commonly found circuits which perform such function as explained more fully below with respect to FIG. 3.

If the current transformer 108 sees very high currents, it will develop fairly high voltage in an attempt to push a proportional current through the variable load resistor 118. Zener diodes 120 and 122 act as voltage suppressors to protect opto-isolator circuit 128 from such high voltages. Zener diodes 120 and 122 can be eliminated if the current transformer 108 and variable load resistor 118 are selected to saturate at 20 volts or less.

As also shown in FIG. 2, line 114 which receives the trip signal is protected by a fuse 130 and an isolating capacitor 132. A voltage dividing network comprising resistors 134, 136 and 138 divide the trip signal to provide an appropriate signal level at input terminals 142 and 144 of opto-isolator circuit 128. Diode 140 is positioned between resistor 138 and input terminal 142.

On the output side of opto-isolator circuit 128, a battery 146 is connected to provide the power to close reed relays 148 and 150 as a function of the signals provided at the input terminals of the opto-isolator circuit 128. More particularly, when the trip signal is supplied by the circuit breakers protective relay scheme at input terminals 142 and 144, the electrical path between output terminals 152 and 154 closes, i.e. becomes conductive. Such closure allows current to flow from the battery 146, through lines 156 and 158, and then through a capacitor 160 and inductive coil 162 of the reed relay 148 before returning to the battery 146 via a line 164. When the electrical power from the battery 146 thus flows through the inductive coil 162, a switch arm 166 in reed relay 148 closes. Similarly, when current transformer 108 provides a sufficiently high level signal on its leads 110 and 112 to close the circuit between output terminals 168 and 170 of opto-isolator circuit 128, power from battery 146 flows through lines 172 and 174, then through a capacitor 176 and an inductive coil 178 in reed relay 150 before returning to battery 146 on line 180. When electrical power from battery 146 thus flows through the inductive coil 178, a switch 182 in reed relay 150 closes.

Thus, the closure of output terminals 168 and 170 provides a binary load signal indicating or not indicating that the current signal produced by the current transformer 108 exceeds the threshold value for the current signal set by variable resistor 118. Since the closure of switch 182 merely tracks the conductiveness of output terminals 168 and 170, it is also seen that switch 182 provides a binary load signal indicating or not indicating that the current signal produced by the current transformer 108 exceeds the threshold value for the current signal set by variable resistor 118.

It is noted that switches 166 and 182 are connected in series across input lines 184 and 186 of display 104 via a line 188. Display 104 includes a counter and is structured to increment the count whenever it detects the simultaneous closure of switches 166 and 182. As seen from the circuitry of FIG. 2, such simultaneous closure of switches 166 and 182 occurs when both the trip signal is provided by the protective relay scheme on lines 114 an 116 and a heavy load condition is sensed by current transformer 108 via lines 110 and 112. Those skilled in the art will recognize that the numeric display within display 104 which displays the actual fault trip count could be replaced with other types of numeric or non-numeric hardware which similarly provides information concerning the cumulative number of actual fault trips such as: (1) hardware which changes color or size as the number of fault trips increases; (2) hardware which slowly disintegrates as the number of fault trips increases; (3) hardware which becomes opaque as the number of fault trips increases; or (4) any other type of hardware which undergoes a change in state as the number of fault trips increases.

The exact operating point at which current transformer 108 produces a sufficient signal to close switch 182 is set as desired by varying the resistance provided by variable resistor 118. In the circumstance where a user prefers a broad range of heavy current levels in the electrical line protected by the circuit breaker to close switch 182, variable resistor 118 may be set so that a threshold value of 5 amperes carried by lines 110 and 112 is sufficient to close switch 182. Of course, the threshold value can be set wherever the user desires. The threshold value is preferably a value which falls in the range from 5 amperes to 20 amperes. More preferably, the threshold value is a value which falls in the range from 7.5 amperes to 15 amperes. Even more preferably, the threshold value is a value which falls in the range from 8 amperes to 12 amperes. It is noted that a threshold value of 8 amperes corresponds to a current load in the electrical line protected by the circuit breaker which is 160% of nominal full current level. For other applications, it may be desirable to set the threshold higher so as to count trips at higher current levels. For these applications, the threshold can be set at or above 10 amperes, perhaps 20 amperes, 30 amperes or even 50 amperes or more.

For situations where the main current transformer of the electrical relay produces a current level different from 5 amperes for nominal full load, the threshold value set by variable resistor 118 is scaled accordingly. For example, if the main current transformer for the circuit breaker provides 10 amperes when the electrical line to be protected is carrying its full nominal current load, then the threshold value set by variable resistor 118 should be double the values provided above. Likewise, if the main current transformer produces ½ amperes for a full nominal current load in the protected lines, then the above threshold values should be reduced by 50%. Since many commercial circuit breakers use current transformers sized to provide 5 amperes at nominal full current level for the lines to be protected, the fault trip indicator 100 of the present invention may be moved among different sizes of circuit breakers so long as the current transformer 108 is connected as an auxiliary current transformer to the main current transformers found on the circuit breaker.

In the situation where the current transformer 108 is coupled directly to the electrical line to be protected by the circuit breaker, the threshold value set by variable resistor 118 would have to be suitably adjusted for whatever current level such nominal full value would produce in lines 110 and 112. The related circuit components would have to be designed to handle the resulting current levels, as well.

In the situation where the fault trip counter is to be used with a three phase circuit breaker, the current transformer 108 can be coupled to the main current transformer of the circuit breaker for the neutral line. By setting variable resistor 118 to make the circuit slightly more sensitive than the settings described above, a reasonably accurate fault trip count can be maintained for such three phase circuit breakers. With suitable adjustments, the current transformer 108 could also be coupled directly to the neutral line of the electrical line to be protected. If the current transformer 108 is coupled to only one of the three phases, then only fault trips concerning that phase will be detected. For the best fault trip counting with three phase circuit breakers, the fault trip counter shown in FIGS. 4 and 5 should be used as explained more fully below.

FIG. 2 also shows a remote terminal unit 408 connected to the counter in display 104 via lines 410 and 412. A 2-bit remote terminal unit input is preferably used to capture the high speed switching of the reed relays 148 and 150. In this way, the reed relay contacts would be connected as "dry" contacts to the unit 408. (Typically, all such inputs to a remote terminal unit are wetted with 12, 24 or 48 volts DC.) The closure of a contact draws only a few milliamps which is well within the capabilities (10 watts maximum or 200VDC maximum at 50 milliamps) of the reed relays 148 and 150. Remote terminal unit 408 is preferably coupled to a communication line to produce a signal on the line each time the counter in display 104 increments the count. Such a communication line could be a telephone line, dedicated path, radio signal to a suitable receiver, microwave transmission, cell telephone or other wireless means of communication. Thus, the signal on the communication line indicates the occurrence of the protective circuit opening the contacts in the circuit breaker while opto-isolator circuit 128 is providing a load signal corresponding to a heavy current level in the protected electrical line. The number of fault trips for the circuit breaker can thereby be monitored at a remote location so long as there is suitable access to a communication line. When it is only necessary to monitor remotely the fault trips in a circuit breaker, display 104 can be omitted and the remote terminal unit 408 can be connected directly to lines 184 and 186.

Figure 3:
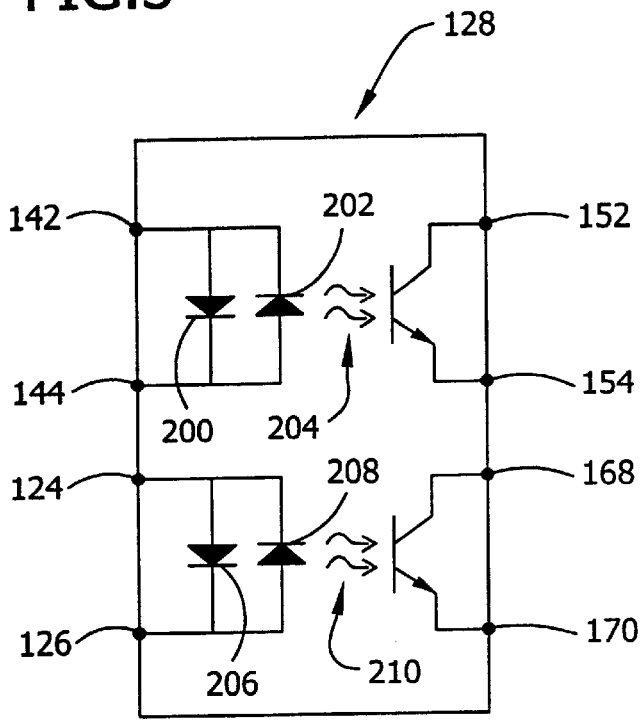
FIG. 3 shows a schematic diagram for an opto-isolator.

FIG. 3 shows the opto-isolator circuit 128 in more detail. In particular, circuit 128 includes a pair of parallel diodes 200 and 202 connected in reverse polarity across input terminals 142 and 144. Such parallel connection of diodes 200 and 202 ensures that the diodes will conduct regardless of the polarity of the input signal. When either diode conducts, it produces light indicated by general reference numeral 204 which closes the circuit between output terminals 152 and 154. A pair of diodes 206 and 208 are connected in parallel across input terminals 124 and 126. The reverse polarity of diodes 206 and 208 ensures that one of the diodes will conduct regardless of the polarity of the input signal applied at input terminals 124 and 126. When either diode conducts, it produces light indicated by general reference numeral 210 which closes the circuit between output terminals 168 and 170.

Opto-isolator circuit 128 is shown for illustration purposes only. Many opto-isolator circuits commonly available could be suitably connected to perform the functions required by the present invention. Many other commonly available isolation circuits could be used as well. For example, when the polarity of the input signals applied at terminals 142/144 and 124/126 is known, a single diode could be used in place of diodes 200/202 and 206/208. Similarly, other types of transistor elements than those shown in the output section of opto-isolator circuit 128 could also be used within the scope of the invention.

As a matter of design, it is important that battery 146 not be drained during use of the fault trip indicator 100. By setting the threshold value for the current signal on lines 108 and 110 sufficiently high via variable resistor 118, diodes 200/202 and 206/208 will not conduct during normal operating current loads appearing on the electrical lines to be protected by the circuit breaker. When these diodes do not conduct, output terminals 152/154 and 168/170 will appear as open circuits, thus conserving battery 146. Using opto-isolator CP CLARE No. EA200, any type of signal of any polarity may be detected on the input side up to 20 peak volts and 100 milliamps. The internal photo diodes 200/202 and 206/208 do not conduct at all below 0.8 input volts, and are full on at 1.1 input volts. Battery 146 is therefore switched on when this small voltage appears on the input. Should the input signal change polarity, the output circuit would briefly stop conducting as the input signal crossed through zero volts, but this is suppressed by capacitors 160 and 176. Capacitor 160 also helps to debounce the contacts in the protective relay scheme of the circuit breaker.

Figure 4:
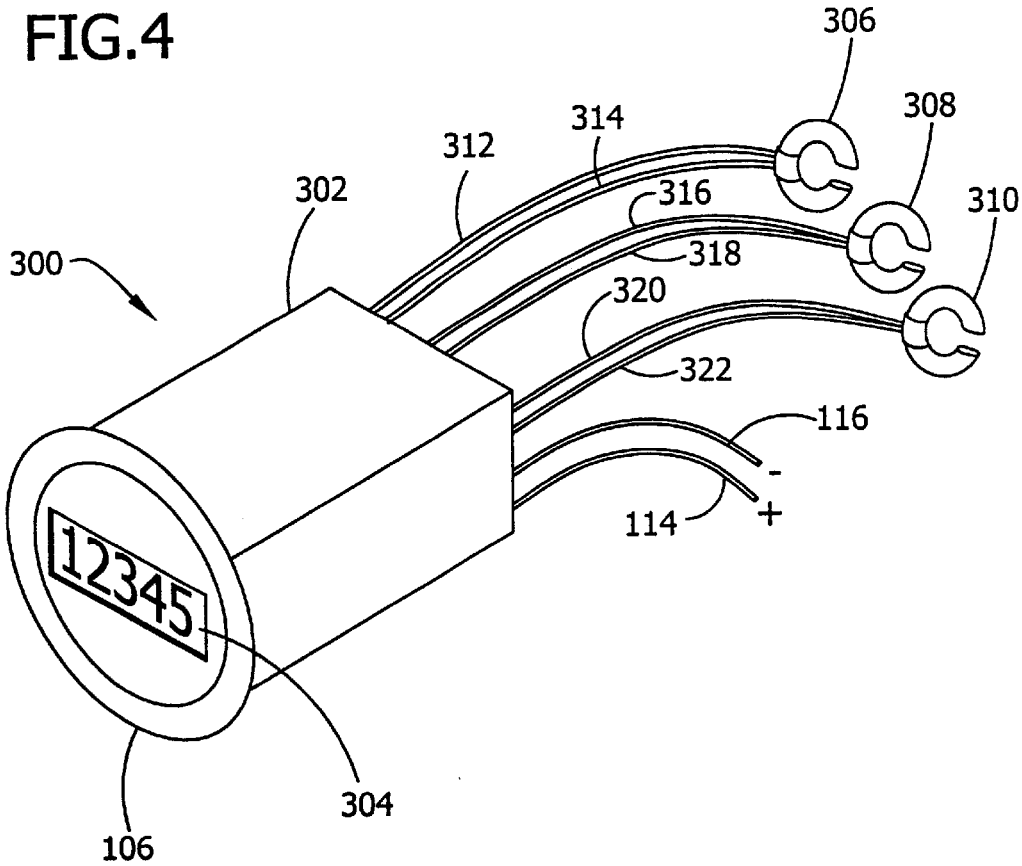
FIG. 4 shows a fault trip indicator of the present invention for a three phase power system.

FIG. 4 shows a fault trip indicator 300 of the present invention used for measuring fault trips in three phase power systems. Fault trip indicator 300 includes a chassis 302 for carrying all of the related electronics and circuitry. A display 304 displays the total number of fault trips detected by indicator 300. Such detected fault trips will include any fault trips occurring in a single or multiple phases of the three phase electrical lines protected by the circuit breaker. When display 304 is reset to zero prior to installation of indicator 300 on a circuit breaker, display 304 will display the total number of fault trips for the circuit breaker since such installation. Indicator 300 may include a mounting ring 106 for semi-permanent installation. Indicator 300 can also be allowed to rest loosely on any suitable support surface where it is installed.

Fault trip indicator 300 includes current transformers 306, 308 and 310 connected, respectively, by lines 312/314, 316/318, and 320/322 to indicator 300. Each of these current transformers is preferably connected to one of the lead lines on the main current transformers of the circuit breaker to be protected. As above, when the main current transformers of the circuit breaker are sized for 5 amperes in their lead lines at full nominal current load for the circuit breaker, auxiliary current transformers 306/308/310 and the related threshold setting circuitry of indicator 300 are similarly adjusted to indicate a nominal full load upon the detection of 5 amperes.

Fault trip indicator 300 also includes lines 114 and 116 for making connection to the protective relay scheme in the circuit breaker. Lines 114 and 116 thereby provide any trip signal for the circuit breaker to the fault trip indicator 300. The occurrence of such a trip signal on lines 114 and 116 indicates that the circuit breaker is in the process of opening its contacts.

Figure 5:
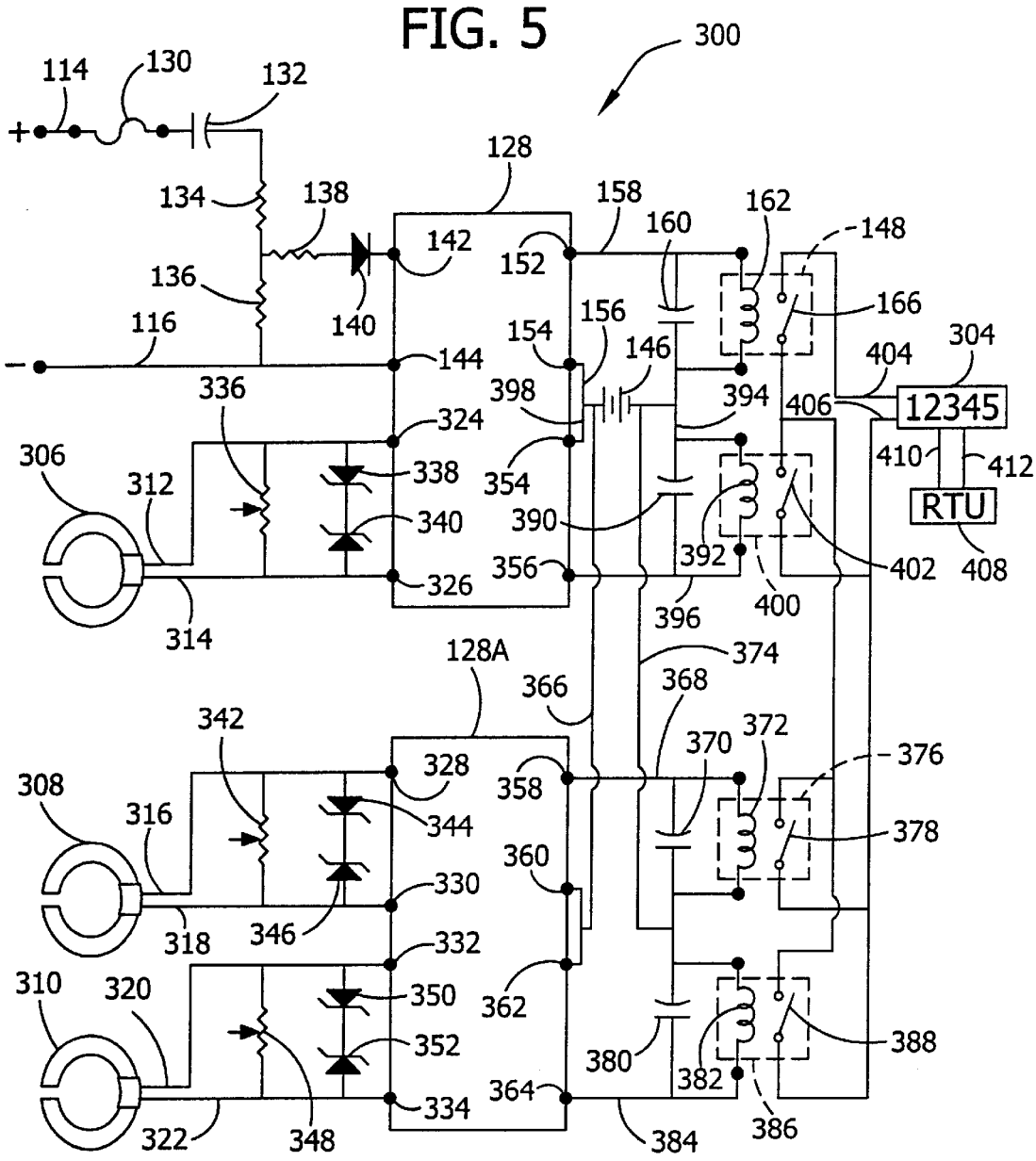
FIG. 5 shows a schematic diagram for a fault trip indicator of the present invention.

FIG. 5 is an electrical schematic diagram for fault trip indicator 300 of the present invention. FIG. 5 is similar to the electrical schematic diagram of FIG. 2 except that FIG. 5 provides three current transformers and related reed relays for monitoring the three phases of a three phase power system. More particularly, fault trip indicator 300 in FIG. 5 includes input lines 114 and 116 for receiving a trip signal from the protective scheme for the circuit breaker. Fuse 130 and capacitor 132 provide protection and isolation. Voltage dividing network 134, 136 and 138 divide the trip signal, typically ranging between 48 and 125 volts DC, to a signal level suitable for opto-isolator circuit 128 via a diode 140. For trip signals with a voltage outside this range, e.g., 24 volts DC or 250 volts DC, the resistor values shown in the table below may need to be resized.

When the protective relay scheme for the circuit breaker provides the trip signal on lines 114 and 116, to input terminals 142 and 144, the circuit between output terminals 152 and 154 closes. Battery 146 then provides power through lines 156 and 158 across capacitor 160 and inductive coil 162 of reed relay 148. This closes switch 166 in reed relay 148. Thus, the trip signal appearing on lines 114 and 116 closes switch 166 of reed relay 148.

Fault trip indicator 300 also includes current transformers 306, 308 and 310. These current transformers are connected to input terminals 324/326, 328/330, and 332/334, respectively. A variable resistor 336 is connected in parallel across opposing series connected zener diodes 338 and 340 and is further connected across input terminals 324 and 326. A variable resistor 342 is connected in parallel across opposing series connected zener diodes 344 and 346 and is further connected across input terminals 328 and 330. A variable resistor 348 is connected in parallel across opposing series connected zener diodes 350 and 352 and is further connected across input terminals 332 and 334.

If any of current transformers 306, 308 or 310 sees very high currents, it will develop fairly high voltage in an attempt to push a proportional current through the variable load resistor 336, 342 and 348, respectively. The respective zener diodes 338/340, 344/346 and 350/352 act as voltage suppressors to protect opto-isolator circuit 128/128A from such high voltages. These zener diodes can be eliminated if the current transformers 306, 308 and 310 and related variable load resistors are selected to saturate at 20 volts or less.

As described for fault trip indicator 100 in FIG. 2, when the current level produced by current transformer 306 is sufficiently high, opto-isolator circuit 128 closes the circuit between output terminals 354 and 356. Likewise, when the current level produced by current transformer 308 is sufficiently high, opto-isolator circuit 128A closes the circuit between output terminals 358 and 360. Likewise, when the current level produced by current transformer 310 is sufficiently high, opto-isolator circuit 128A closes the circuit between output terminals 362 and 364.

When opto-isolator circuit 128A closes the circuit between output terminals 358 and 360, battery 146 supplies power across the parallel connection of a capacitor 370 and an inductive coil 372 via line 366, 368 and 374. Inductive coil 372 is the input coil of a reed relay 376. When the battery powers inductive coil 372, a switch 378 of reed relay 376 closes. Similarly, when opto-isolator circuit 128A closes the circuit between output terminals 362 and 364, battery 146 supplies power across the parallel connection of a capacitor 380 and an inductive coil 382 via lines 384, 366 and 374. Inductive coil 382 is the input coil for a reed relay 386. When battery 146 thus energizes inductive coil 382, a switch 388 of reed relay 386 closes. Similarly, when opto-isolator circuit 128 closes the circuit between output terminals 354 and 356, battery 146 supplies power across the parallel connection of a capacitor 390 and an inductive coil 392 via lines 394, 396 and 398. Inductive coil 392 is the input coil for a reed relay 400. When battery 146 thus energizes inductive coil 392, a switch 402 of reed relay 400 closes.

Thus, the closure of output terminals 358/360, 362/364 and/or 354/356 provides a binary load signal indicating or not indicating that the current signal produced by the respective current transformer 308, 310 and/or 306 exceeds the threshold value for the current signal set by respective variable resistor 342, 348 and/or 336. Since the closure of respective switches 378, 388 and/or 402 merely tracks the conductiveness of respective output terminals 358/360, 362/364 and/or 354/356, it is also seen that switches 378, 388 and 402 provide a binary load signal indicating or not indicating that the current signal produced by their respective current transformers exceeds the threshold value for the current signal set by their respective variable resistors.

It will be noted that each of reed relays 378, 388 and 400 are connected in parallel with each other. These parallel reed relays are then connected in series with reed relay 148 across the input terminals 404 and 406 of display 304. The practical effect of such connection is that the counter in the display 304 increments the count each time both: (1) a trip signal is detected from the protective relay scheme for the circuit breaker on lines 114 and 116; and (2) any of current transformers 306, 308 and/or 310 detects a sufficient load to close the switch in any of reed relays 400, 376 and/or 386, respectively. More simply, display 304 will increment the displayed count any time it simultaneously detects a trip signal for the circuit breaker and an overload condition in any one of the three phases of the power system being monitored.

The exact operating point at which current transformers 306, 308 and 310 produce a sufficient signal to close switches 402, 378 and 388, respectively, is set as desired by varying the resistance provided by variable resistors 336, 342 and 348, respectively. In the circumstance where a user prefers a broad range of heavy current levels in the electrical line protected by the circuit breaker to close switches 402, 378 and 388, variable resistors 336, 342 and 348 may be set so that a threshold value of 5 amperes carried by lines 312/314, 316/318 and 320/322, respectively, is sufficient to close these switches. Of course, the threshold value can be set wherever the user desires. The threshold value is preferably a value which falls in the range from 5 amperes to 20 amperes. More preferably, the threshold value is a value which falls in the range from 7.5 amperes to 15 amperes. Even more preferably, the threshold value is a value which falls in the range from 8 amperes to 12 amperes. It is noted that a threshold value of 8 amperes corresponds to a current load in the electrical line protected by the circuit breaker which is 160% of nominal full current level. For other applications, it may be desirable to set the threshold higher so as to count trips at higher current levels. For these applications, the threshold can be set at or above 10 amperes, perhaps 20 amperes, 30 amperes or even 50 amperes or more.

For situations where the main current transformer of the electrical relay produces a current level different from 5 amperes for nominal full load, the threshold value set by variable resistors 336, 342 and 348 is scaled accordingly. For example, if the main current transformer for the circuit breaker provides 10 amperes when the electrical line to be protected is carrying its full nominal current load, then the threshold value set by variable resistors 336, 342 and 348 should be double the values provided above. Likewise, if the main current transformer produces 2 ½ amperes for a full nominal current load in the protected lines, then the above threshold values should be reduced by 50%. Since many commercial circuit breakers use current transformers sized to provide 5 amperes at nominal full current level for the lines to be protected, the fault trip indicator 300 of the present invention may be moved among different sizes of circuit breakers so long as the current transformers 306, 308 and 310 are connected as auxiliary current transformers to the main current transformers found on the circuit breaker.

In the situation where the current transformers 306, 308 and 310 are coupled directly to the electrical line to be protected by the circuit breaker, the threshold value set by variable resistors 336, 342 and 348 would have to be suitably adjusted for whatever current level such nominal full value would produce in lines 312/314, 316/318 and 320/322, respectively. The related circuit components would have to be designed to handle the resulting current levels, as well.

FIG. 5 also shows a remote terminal unit 408 connected to the counter in display 304 via lines 410 and 412. A 2-bit remote terminal unit input is preferably used to capture the high speed switching of the reed relays 148, 400, 376 and 386. In this way, the reed relay contacts would be connected as "dry" contacts to the unit 408. (Typically, all such inputs to a remote terminal unit are wetted with 12, 24 or 48 volts DC.) The closure of a contact draws only a few milliamps which is well within the capabilities (10 watts maximum or 200VDC maximum at 50 milliamps) of the reed relays 148, 400, 376 and 386. Remote terminal unit 408 is preferably coupled to a communication line to produce a signal on the communication line each time the counter in display 304 increments the count. Thus, the signal on the communication line indicates the occurrence of the protective circuit opening the contacts in the circuit breaker while opto-isolator circuit 128 and/or 128A is providing a load signal corresponding to a heavy current level in at least one of the phases of the protected electrical line. The number of fault trips for the circuit breaker can thereby be monitored at a remote location so long as there is suitable access to a communication line. When it is only necessary to monitor remotely the fault trips in a circuit breaker, display 304 can be omitted and the remote terminal unit 408 can be connected directly to lines 404 and 406.

It is noted that commercial electronic cycle counters will register a count by the closure of an external dry contact. The speed limitation is typically 8 to 10 milliseconds "close" followed by 8 to 10 milliseconds "open." The fastest power circuit breakers in use will take 30 milliseconds to reach full open after a trip signal is given, and another 30 milliseconds to reach full close after an instantaneous reclose. Sixty milliseconds for both values is more typical. The reed relays were chosen because very low power switching is needed and they are low cost, compact, very high speed, vibration resistant, and require as little as 2 volts DC coil voltage. Reed relays do require a fairly clean DC signal; therefore, isolation is provided by the opto-isolator circuits 128 and 128A.

Figure 6:
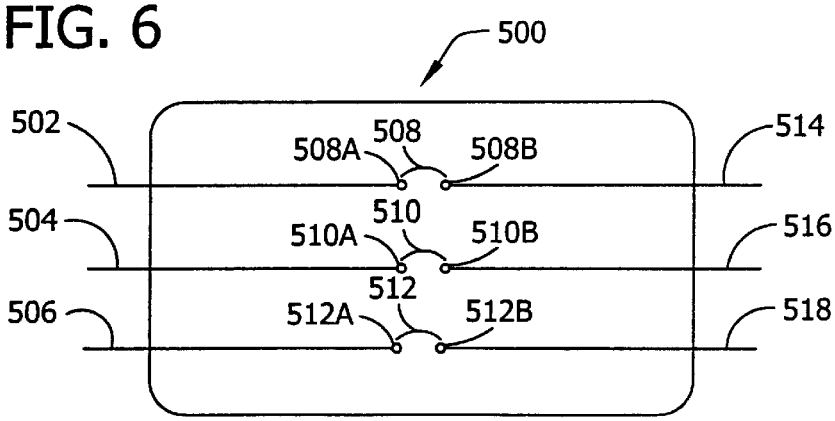
FIG. 6 shows a schematic diagram of the electrical contacts in a circuit breaker on which maintenance per the present invention may be performed.

FIG. 6 shows a schematic diagram of selected components in a circuit breaker. More particularly, a contact assembly 500 in a circuit breaker is shown receiving three phase power via lines 502, 504 and 506 which is then output via lines 514, 516 and 518, respectively, when switches 508, 510 and 512, respectively, are closed. Otherwise, the circuit breaker is in the open position and no current is allowed to flow through the breaker. The protective relay scheme for the circuit breaker controls whether the switches are in the open or closed position. When the protective relay scheme produces the trip signal, related hardware moves the switches to the open position. Each of switches 508, 510 and 512 includes replaceable electrical contacts 508A, 508B, 510A, 510B, A512 and 512B. These are the contacts which suffer wear from a fault trip and which must be replaced as part of the expected maintenance for the circuit breaker. These contacts are submersed in oil. Fault trips also degrade the oil which requires that the oil be filtered or replaced as a matter of maintenance.

In use, a fault trip indicator 100 or 300 (as more fully described above) is connected to a circuit breaker. A maintenance schedule is prepared for the circuit breaker. The maintenance schedule may include a threshold value corresponding to the number of fault trips which the breaker can provide before the contacts should be serviced or replaced. The maintenance schedule may also include a threshold value corresponding to the number of fault trips which the breaker can provide before the oil must be filtered or replaced. For circuit breakers that do not use oil, a schedule can be prepared and thresholds set for any type of maintenance where the need for the maintenance is driven by the number of fault trips provided by the circuit breaker. Then, as the circuit breaker is used, a maintenance worker monitors the fault trip indicator 100 or 300 and performs the maintenance per the maintenance schedule.

Turning now to a few design considerations for fault trip indicator 100 or 300, installation of the indicator does not alter the monitored circuit or impede the circuit breaker's relay protection scheme. A defect in the indicator is self-clearing and does not jeopardize the circuit breaker's protection scheme. The detection circuit uses capacitor coupling and opto-isolators to achieve this. Moreover, with a suitable input threshold level, the sensing circuitry is "passive"—it draws substantially no power except for the LCD display, and except during the brief time that the circuit breaker actually operates. Because of the type of circuitry used, no power supply is needed. One lithium battery powers the reed relays and a separate lithium battery preferably powers an LCD display 104 or 304. This saves the space and weight of a power supply and reduces the extra installation time needed for power connections. It also avoids making accommodations for various supply voltages and circuit protection. Further, the indicator is designed to be easy to install, and can be done without de-energizing the circuit breaker.

The only connections to the circuit breaker are the +/−leads 114 and 116 which detect the DC voltage applied to the breaker's shunt trip coil; and one to three current transformers preferably clipped over the secondary leads of the main current transformers of the circuit breaker. In practice, a split core current transformer can be installed without breaking connections. Split core current transformers are available with about a 1 inch diameter and a ⅜ inch window. Alternatively, circuit breakers often have shorting blocks which enable the quick installation of a non-split core current transformer. A round faceplate and a rectangular case give the installer the option of mounting the indicator in a round hole, punched into a control panel, or the ability to mount it on any flat surface. The circuit breaker's CT secondary circuits and the DC connections are available both at the circuit breaker's control cabinet, and at the relay panel which is sometimes attached to the control cabinet or sometimes in a nearby control building. This gives the installer options when locating the indicator, and there are never any constrictions from power supply concerns when a battery is used for power.

The following table identifies particular circuit components preferably used for the schematic diagrams of FIGS. 2 and 5:

| Reference Numeral(s) | Component Description |
|---|---|
| 134 | Resistor 830Ω, 1 watt |
| 136, 138 | Resistor 390Ω, 1 watt |
| 118, 336, 342, 348 | Resistor 40 to 100Ω, 1 watt, resistance matched to CT |
| 120, 122, 338, 340, 344, 346, 350, 352 | Zener diodes (voltage suppressor) 6.2 volt, ½ watt. - may be eliminated if CT saturates at less than 20 V on variable resistors 118, 336, 342 or 348 |
| 128, 128A | Current sensor (opto-isolator) CP Clare #LDA200, or similar |
| 148, 376, 386, 400 | Reed relay, 5 V 500Ω coil, 1-NO contact, Hamlin #HE3321A0500, or similar |
| 132 | Capacitor, 8 uF @ 350 VDC |
| 176, 370, 380, 390 | Capacitor, 30 uF @ 35 VDC |
| 160 | Capacitor, 10 uF @ 35 VDC |
| 140 | Diode, glass, axial #5082-2810 |
| 108, 306, 308, 310 | Current transformer, EITHER Magnelab split style, or Davis Instruments #CA631203 closed ring. Approx. 5 A: 10 mA with approximately #24 twisted pair wires |
| 114 | Fuse, 20 mm size, 0.1 amp |
| 146 | Battery, ½ N size 6 V lithium |
| 104, 304 | Display/Counter/Totalizer, Redington Model 5300-0000, non-voltage, switch input DC sensing |
| 114, 116 | wires: #20 1000 V test lead wire |

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A fault trip indicator for use with a circuit breaker connected to protect an electrical line, the circuit breaker having a protective circuit for opening the circuit breaker during a heavy load condition on the electrical line, the protective circuit including a main current transformer for sensing a current level flowing through the electrical line, the fault trip indicator comprising:

an auxiliary current transformer coupled to the main current transformer to produce a current signal which varies as a function of a current level produced by the main current transformer;

a threshold detector coupled to the auxiliary current transformer to produce a load signal when the threshold detector detects that the current signal exceeds a threshold value; and a monitoring circuit coupled to the protective circuit and the threshold detector for providing an indication of the occurrence of the protective circuit opening the circuit breaker while the threshold detector is producing the load signal.

2. The fault trip indicator of claim 1 wherein the monitoring circuit comprises a counter for storing a count, wherein the counter increments the count in response to the occurrence of the protective circuit opening the circuit breaker while the threshold detector is producing the load signal.

3. The fault trip indicator of claim 2 further comprising a display coupled to the counter for displaying a number as a function of the count stored in the counter.

4. The fault trip indicator of claim 3 wherein the threshold value is a value which falls in a range from 5 amperes to 20 amperes.

5. The fault trip indicator of claim 1 wherein the monitoring circuit comprises a remote terminal unit coupled to the protective circuit, the threshold detector and a communication line; wherein the remote terminal unit produces a signal on the communication line each time the monitoring circuit provides an indication of the occurrence of the protective circuit opening the circuit breaker while the threshold detector is producing the load signal.

6. The fault trip indicator of claim 1 wherein the threshold value is a value which falls in a range from 5 amperes to 20 amperes.

7. The fault trip indicator of claim 1 wherein the threshold value is a value which falls in a range from 7.5 amperes to 15 amperes.

8. The fault trip indicator of claim 1 wherein the threshold value is a value which is at or above 10 amperes.

9. The fault trip indicator of claim 1 wherein the threshold detector comprises a passive circuit which consumes substantially no power at a time when the current signal does not exceed the threshold value.

10. The fault trip indicator of claim 1 wherein the electrical line further comprises a neutral line; and wherein the main current transformer is coupled to the neutral line.

11. The fault trip indicator of claim 1 wherein the electrical line further comprises a three phase line; and wherein:

the fault trip indicator further comprises a plurality of auxiliary current transformers;

a separate auxiliary current transformer is coupled to each of the separate phases; and the threshold detector is coupled to each of the separate auxiliary current transformers and produces the load signal when the threshold detector detects that a current signal produced by one of the separate auxiliary current transformers exceeds the threshold value.

12. The fault trip indicator of claim 1 wherein the current signal produced by the auxiliary current transformer has either a positive or a negative polarity; and wherein the threshold detector produces the load signal when the threshold detector detects that the positive or negative polarity current signal exceeds the threshold value.

13. The fault trip indicator of claim 1 wherein the threshold detector further comprises a reed relay which closes to produce the load signal.

14. The fault trip indicator of claim 1 wherein the threshold detector further comprises an opto-isolator which becomes conductive to produce the load signal.

15. A fault trip indicator for use with a circuit breaker connected to protect an electrical line, the circuit breaker having a protective circuit for opening the circuit breaker during a heavy load condition on the electrical line, the fault trip indicator comprising:

a current transformer coupled to the electrical line to produce a current signal which varies as a function of a current level flowing through the electrical line;

a battery-powered threshold detector coupled to the current transformer to produce a load signal when the threshold detector detects that the current signal exceeds a threshold value; and a monitoring circuit coupled to the protective circuit and the threshold detector for providing an indication of the occurrence of the protective circuit opening the circuit breaker while the threshold detector is producing the load signal.

16. The fault trip indicator of claim 15 wherein the circuit breaker comprises a main current transformer coupled to the electrical line and wherein the current transformer comprises an auxiliary current transformer coupled to the main current transformer.

17. The fault trip indicator of claim 15 wherein the monitoring circuit comprises a counter for storing a count, wherein the counter increments the count in response to the occurrence of the protective circuit opening the circuit breaker while the threshold detector is producing the load signal.

18. The fault trip indicator of claim 17 further comprising a display coupled to the counter for displaying a number as a function of the count stored in the counter.

19. The fault trip indicator of claim 18 wherein the threshold value is a value which falls in a range from 5 amperes to 20 amperes.

20. The fault trip indicator of claim 15 wherein the threshold value is a value which falls in a range from 7.5 amperes to 15 amperes.

21. A fault trip indicator for use with a circuit breaker connected to protect an electrical line, the circuit breaker having a protective circuit for opening the circuit breaker during a heavy load condition on the electrical line, the fault trip indicator comprising:

a current transformer coupled to the electrical line to produce a current signal which varies as a function of a current level flowing through the electrical line;

a threshold detector coupled to the current transformer to produce a binary load signal when the threshold detector detects that the current signal exceeds a threshold value; and a monitoring circuit coupled to the protective circuit and the threshold detector for providing an indication of the occurrence of the protective circuit opening the circuit breaker while the threshold detector is producing the binary load signal.

22. The fault trip indicator of claim 21 wherein the circuit breaker comprises a main current transformer coupled to the electrical line and wherein the current transformer comprises an auxiliary current transformer coupled to the main current transformer.

23. The fault trip indicator of claim 21 wherein the monitoring circuit comprises a counter for storing a count, wherein the counter increments the count in response to the occurrence of the protective circuit opening the circuit breaker while the threshold detector is producing the load signal.

24. The fault trip indicator of claim 23 further comprising a display coupled to the counter for displaying a number as a function of the count stored in the counter.

25. The fault trip indicator of claim 24 wherein the threshold value is a value which falls in a range from 5 amperes to 20 amperes.

26. The fault trip indicator of claim 21 wherein the threshold value is a value which falls in a range from 7.5 amperes to 15 amperes.

27. A fault trip indicator for use with a circuit breaker connected to protect an electrical line, the circuit breaker having a protective circuit for opening the circuit breaker during a heavy load condition on the electrical line, the fault trip indicator comprising:

a current transformer coupled to the electrical line to produce a current signal which varies as a function of a current level flowing through the electrical line;

a passive threshold detector coupled to the current transformer to produce a load signal when the threshold detector detects that the current signal exceeds a threshold value; and an indicator coupled to the protective circuit and the threshold detector to provide an indication of the occurrence of the protective circuit opening the circuit breaker while the threshold detector is producing the load signal.

28. A method of performing maintenance on a circuit breaker, the circuit breaker being connected to protect an electrical line and being of a type having a protective circuit for opening the circuit breaker during a heavy load condition on the electrical line, the method comprising:

producing a current signal which varies as a function of a current level flowing through the electrical line;

establishing a first threshold value;

producing a binary load signal as a function of the current signal and the first threshold value;

providing an indication of the occurrence of the protective circuit opening the circuit breaking while the binary load signal is being produced;

establishing a second threshold value; and performing maintenance on the circuit breaker as a function of the indication and the second threshold value.

29. The method of claim 28 wherein the providing element further comprises:

storing a count; and incrementing the stored count in response to the occurrence of the opening of the circuit breaker while the binary load signal is being produced;

wherein the performing element further comprises performing maintenance on the circuit breaker as a function of the stored count and the second threshold value.

30. A method of performing maintenance on a circuit breaker, the circuit breaker being connected to protect an electrical line and being of a type having a protective circuit for opening the circuit breaker during a heavy load condition on the electrical line, the method comprising:

producing a current signal which varies as a function of a current level flowing through the electrical line;

establishing a first threshold value;

using battery power to produce a load signal as a function of the current signal and the first threshold value;

providing an indication of the occurrence of the protective circuit opening the circuit breaking while the load signal is being produced;

establishing a second threshold value; and performing maintenance on the circuit breaker as a function of the indication and the second threshold value.

31. The method of claim 30 wherein the providing element further comprises:

storing a count; and incrementing the stored count in response to the occurrence of the opening of the circuit breaker while the load signal is being produced;

wherein the performing element further comprises performing maintenance on the circuit breaker as a function of the stored count and the second threshold value.

* * * * *